US006215378B1

(12) United States Patent
Gibson et al.

(10) Patent No.: US 6,215,378 B1
(45) Date of Patent: Apr. 10, 2001

(54) CIRCUIT BREAKER WITH DUAL FUNCTION TEST BUTTON REMOTE FROM TEST CIRCUIT

(75) Inventors: Jeffrey Scott Gibson, Aliquippa; Jeffrey Wayne Lockhart, Fombell; Michael Joseph Erb, Pittsburgh, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/491,005

(22) Filed: Jan. 25, 2000

(51) Int. Cl.[7] ..... H01H 83/06
(52) U.S. Cl. ..... 335/18; 361/42
(58) Field of Search ..... 335/18; 361/42–51

(56) References Cited

U.S. PATENT DOCUMENTS 4,686,600 8/1987 Morris et al. .
4,823,225 4/1989 Foster et al. .
4,851,951 7/1989 Foster, Jr. .
5,260,676 11/1993 Patel et al. .
5,293,522 3/1994 Fello et al. .
5,459,630 * 10/1995 MacKenzie et al. ..... 361/45
5,546,266 8/1996 Mackenzie et al. .
5,552,755 * 9/1996 Fello et al. ..... 335/18

* cited by examiner

*Primary Examiner*—Lincoln Donovan
(74) *Attorney, Agent, or Firm*—Martin J. Moran

(57) ABSTRACT

A miniature circuit breaker has an arc fault detector and a ground fault detector each with its own test circuit. Test switches for the two test circuits are mounted on a printed circuit board and share a common test contact formed by a flat U-shaped leaf spring. The common test contact is deflected into engagement with another test contact for one or the other of the two test switches by a remotely mounted common test button through a common test actuating member which is moved generally rectilinearly by rocking the common test button.

4 Claims, 3 Drawing Sheets

CIRCUIT BREAKER WITH DUAL FUNCTION TEST BUTTON REMOTE FROM TEST CIRCUIT

RELATED APPLICATION

Commonly owned, concurrently filed application entitled "Circuit Breaker with Common Test Button for Separate Testing of Ground Fault and Arc Fault Function" and bearing Ser. No. 09/496,566.

FIELD OF THE INVENTION

This invention relates to circuit breakers provided with two test circuits, such as a ground fault test circuit and an arc fault test circuit, and a single, dual function test button for selectively activating switches in the test circuits which are remote from the common test button.

BACKGROUND INFORMATION

Circuit breakers provide overcurrent and short circuit protection for electric power systems. In the small circuit breakers, commonly referred to as miniature circuit breakers, used for residential and light commercial applications, such protection is typically provided by a thermal-magnetic trip device. Such a device includes a bimetal which is heated and bends in response to a persistent overcurrent condition thereby unlatching a spring powered operating mechanism which opens the separable contacts of the circuit breaker to interrupt current flow in the protected power system. An armature attracted by the sizable magnetic forces generated by a short circuit also unlatches, or trips, the operating mechanism.

In many applications, the miniature circuit breaker also provides ground fault protection. An electronic circuit detects leakage of current to ground and generates a ground fault trip signal. This signal energizes a shunt trip solenoid which unlatches the operating mechanism, typically through actuation of the thermal-magnetic trip device.

Recently, there has been considerable interest in also providing protection against arcing faults. Arcing faults are intermittent high impedance faults which can be caused for instance by worn insulation, loose connections, broken conductors, and the like. Because of their intermittent and high impedance nature, arcing faults do not generate currents of sufficient instantaneous magnitude or sufficient average current to rigger the thermal-magnetic trip device. Consequently, separate electrical circuits have been developed for responding to arcing faults.

Ground fault protection circuits and arc fault protection circuits typically include test circuits for affirming their continued operability. Currently, separate test switches, each with its own test button, are provided for performing the ground fault and arc fault tests. However, the molded cases of the miniature circuit breakers have been standardized for interchangeable use in load centers. There is limited space available in the standardized miniature circuit breakers for all of the additional circuitry required for ground fault and arc fault protection, let alone the test circuits.

U.S. patent application Ser. No. 09/069,355 filed on Apr. 29, 1998 discloses a miniature circuit breaker with a common rocker button which is rotated in one direction to actuate the ground fault test circuit, and the opposite direction to actuate the arc fault test circuit. The ground fault and arc fault test circuits are mounted on a common printed circuit board (PCB) and each has a spring contact arm projecting from the printed circuit board and which is deflected into contact with a common flexible contact extending between them by a separate finger on the common rocker button to actuate the associated test circuit. This arrangement works fine for circuit breakers where the circuit board is in close proximity to the common rocker button so that the spring contact arms can be directly engaged by the rocker button.

Unfortunately, on other miniature circuit breakers, the printed circuit board on which the test circuit is implemented is spaced from the test button so that the above-described direct engagement between a common rocker button and test switches is not possible.

There is a need, therefore, for improved miniature circuit breakers having both ground fault and arc fault test circuits.

More particularly, there is a need for such circuit breakers with a common test button which can separately actuate the ground fault and arc fault test circuits even though and the associated actuating switches are not in close proximity to the common test button.

SUMMARY OF THE INVENTION

These needs and others are satisfied by the invention which is directed to a circuit breaker which includes a molded housing containing electronic trip means having a first test circuit with a first test switch including a first test contact, and a second test circuit with a second test switch including a second test contact spaced from the first test contact. A common test contact associated with both the first and second test contacts is positioned between them. The circuit breaker also has a dual test switch actuating assembly which includes a common test button mounted in the molded housing remotely from the test switches. This common test button is coupled to a common actuating member which is moved by the common test button, preferably generally rectilinearly, between a first test position and a second test position. In the first test position, either the first test contact or the common test contact is deflected by the common actuating member into engagement with the other to actuate the first test switch in the first test circuit. In the second test position, either the second test contact or the common test contact is deflected by the common actuating member into engagement with the other to actuate the second test switch and thereby activate the second test circuit. The circuit breaker further includes bias means biasing the actuating member and also the common test button to a neutral position between the first and second test positions.

Preferably, the common test button is pivotally mounted for rotation in a first direction to move the actuating member against the bias means to the first test position and for rotation in a second direction opposite the first direction to move the actuating member against the bias means to the second test position.

In a preferred embodiment of the invention, the bias means comprises a cantilevered spring member engaging the actuating member and extending laterally relative to the generally rectilinear movement of the actuating member. Most preferably, the actuating member is a molded member and the cantilevered spring member is integrally molded with the actuating member. In the exemplary embodiment of the invention, the integrally molded cantilever member terminates in a tip which seats in recess in the molded housing. The tip rotates in this recess as the actuating member moves generally rectilinearly.

Preferably, the electronic circuits include a printed circuit (PCB). The first and second switch contacts are mounted on the printed circuit board and the common spring contact comprises an electrically conducting leaf spring secured at a first end to the PCB and deflectable at a second end in the first direction of the generally rectilinear movement of the actuator to engage the first switch contact. This common electrically conductive leaf spring is deflectable in the second direction of the generally rectilinear movement of the actuator to engage the second switch contact. Preferably, the first switch contact and the second switch contact arc electrically conductive leaf springs mounted on the PCB and deflectable with the common test contact.

Finally, the common test leaf spring is an elongated U-shaped flat member with two ends adjacent to one another. This shape allows for required deflection without overstressing while minimizing the amount of space occupied on PCB.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a single pole miniature circuit breaker of the type commonly used in residential and light commercial applications. However, it will be evident to those skilled in the art that the invention is also applicable to other types of circuit breakers, as well.

Figure 1:
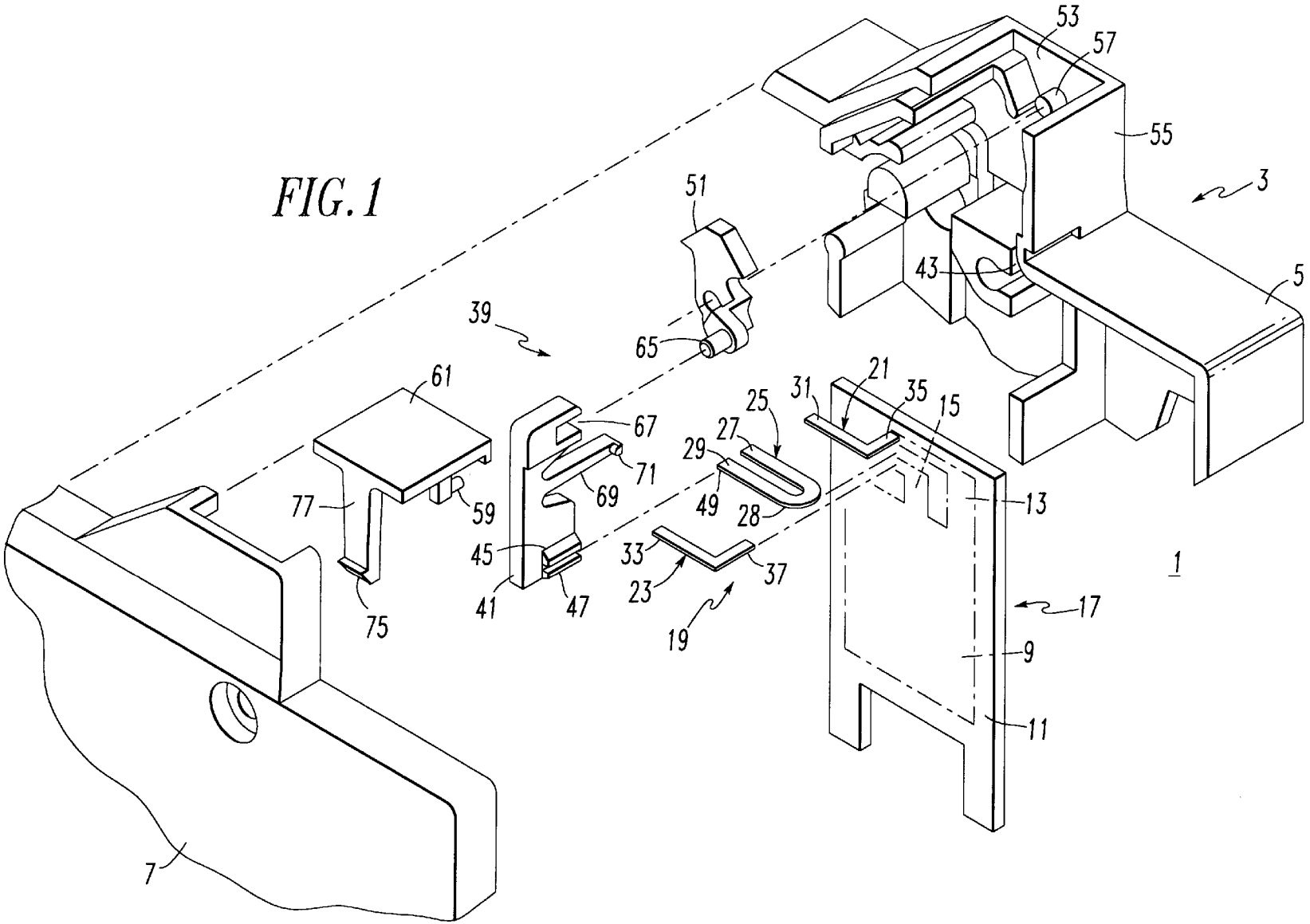
FIG. 1 is an exploded, fragmentary, isometric view of a circuit breaker incorporating the invention.
Figure 2:
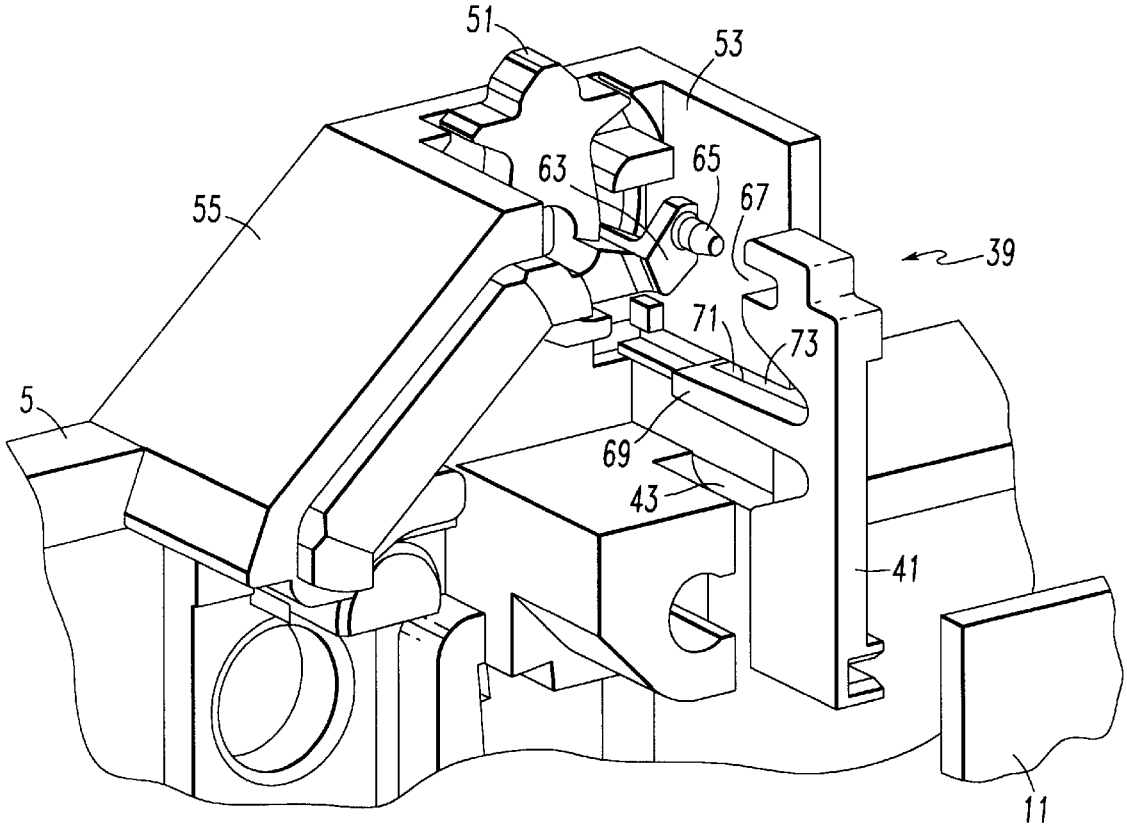
FIG. 2 is an isometric fragmentary view of the circuit breaker of FIG. 1 partially assembled.

Referring to FIG. 1, the circuit breaker 1 has a housing 3 which is assembled from molded sections composed of electrically insulating material and includes a base 5 and a cover 7. The circuit breaker includes the conventional thermal-magnetic trip mechanism (not shown) which provides protection from overcurrents and short circuits, as is well known. In addition, an electronic trip circuit 9, which provides protection from ground faults and arc faults, is implemented on a printed circuit board 11. The electronic trip circuit 9 includes a ground fault test circuit 13 and an arc fault test circuit 15. A ground fault test switch 17 energizes the ground fault test circuit 13 when actuated. Similarly, an arc fault test switch 19 energizes the arc fault test circuit 15 when energized. The ground fault test switch 17 includes a ground fault fixed test contact 21 mounted on the printed circuit board 11 while the arc fault test switch 19 also includes a fixed test contact 23 mounted on the printed circuit board and spaced in parallel relation to the ground fault fixed test contact 21. The ground fault test switch 17 and arc fault test switch 19 share a common moveable contact 25 which is positioned between the contacts 21 and 23. The common switch contact 25 is a U-shaped electrically conductive leaf spring having a first leg 27 terminating in a first end 28 secured to the printed circuit board 11 and a deflectable, free second leg 29. The ground fault fixed test contact 21 and the arc fault fixed test contact 23 are each L-shaped with a first leg 31 and 33, respectively, fixed to the printed circuit board and with second, deflectable legs 35 and 37, respectively, cantilevered outward as to form leaf springs which straddle the second leg 29 of the U-shaped common switch contact. The ground fault test switch 17 and the arc fault test switch 19 are alternatively actuated by a dual test switch actuating assembly 39. This assembly 39 includes a common actuating member 41, which, as can be seen from FIG. 2, is guided for rectilinear reciprocal movement in a slot 43 molded into the base 5. The common actuating member 41 has on its lower end an elongated projection 45 forming a groove 47 which is engaged by the free end 49 of the second leg 29 of the common switch contact 25.

The common actuating member 41 is reciprocally moved within the slot 43 by a common test button 51. This common test button 51 is seated in a recess 53 in an escutcheon 55 molded on the housing 3. The test button is pivotally mounted on a pin 57 molded in the recess 53 and an opposed pin 59 on a cap 61. The common test button 51 has an actuating arm 63 which supports a drive pin 65 offset from the pivot access formed by the pins 57 and 59. The drive pin 65 engages a notch 67 in the upper end of the common actuating member 41. Integrally molded with the common actuating member 41 is a cantilevered spring member 69. This spring member has a projection 71 extending laterally from the free end which is captured in a groove 73, within the recess in the base 5. Alternatively, the spring could be a separate item such as, for example, a leaf spring or a helical spring.

The circuit breaker is assembled by positioning the printed circuit board 11 within the base 5. The common test button 51 is mounted in the recess 53 on the pivot pin 57. The pin 71 on the spring member 69 is then inserted in the groove 73 and the common actuating member 41 is then slid into the slot 43. As this occurs, the groove 47 engages the free end 49 of the leg 29 of the U-shaped common switch contact 25 and the notch 67 is engaged by the drive pin 65. The cover 7 is then secured to the base 5. The assembled circuit breaker is then tested and any required adjustments to the thermal-magnetic trip can be made by insertion of a tool through the unoccupied portion of the recess 43 adjacent the cover 7. When final adjustments have been made, the cap 61 is inserted into the remaining open space of recess 53 with the pin 59 engaging the common test button 51 and with a hook 75 on a cantilevered finger 77 engaging the cover 7.

Figure 3:
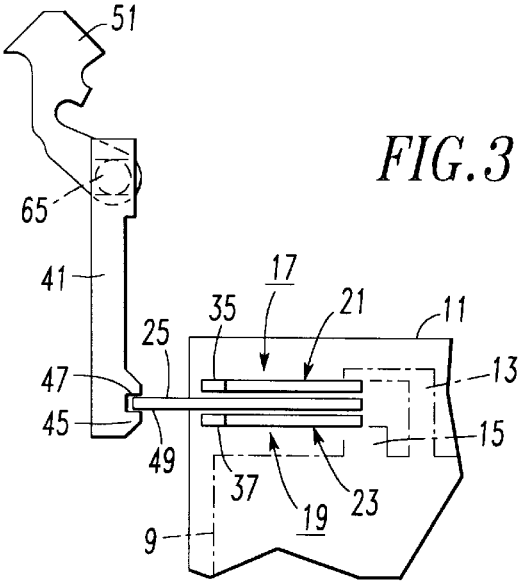
FIG. 3 is an elevational view of pertinent parts of the circuit breaker shown in the neutral position.
Figure 4:
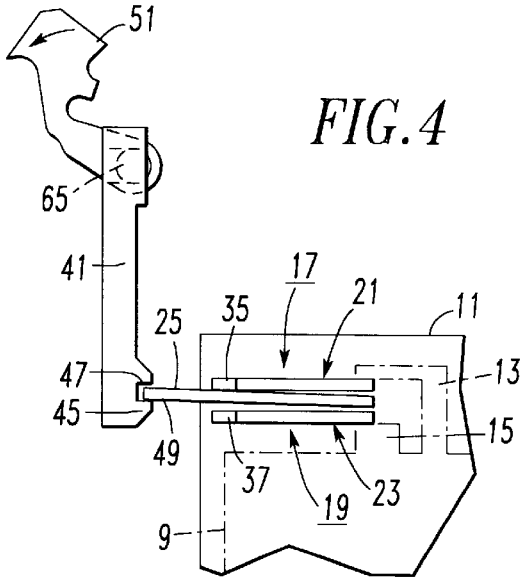
FIG. 4 is similar to FIG. 3 showing the parts in position for testing the ground fault detector of the circuit breaker.

The spring member 69 biases the common actuating member 41 to the neutral position shown in FIG. 3 in which the common switch contact 25 is in a relaxed position in which it is centered between the arc fault fixed test contact 21 and the ground fault fixed test contact 23. Rocking the common test button 51 counterclockwise raises the common actuating member 41 to the ground fault test position shown in FIG. 4 in which the common switch contact 25 is lifted into contact with the second leg 35 of the ground fault fixed test contact 21, thereby initiating test of the ground fault detector in the electronic trip circuit 9. Upon release of the common test button 51, the spring member 69 returns the common actuating member 41 and therefore the test button 51 to the neutral position shown in FIG. 3.

Figure 5:
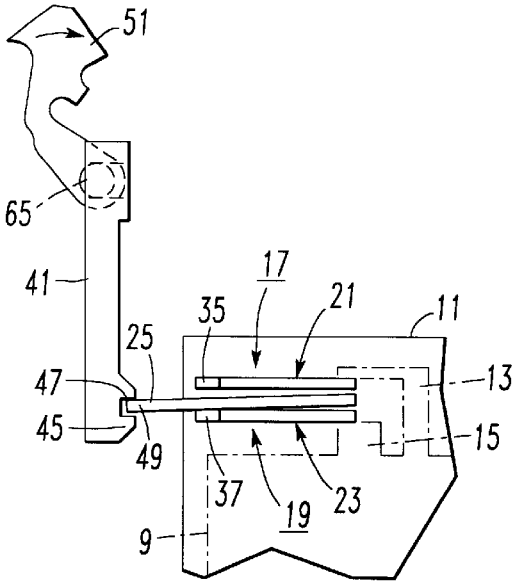
FIG. 5 if a view similar to FIG. 3 illustrating the parts and position for testing the arc fault circuit of the circuit breaker.

For testing the arc fault detector in the electronic trip circuit 9, the common test button 51 is rotated clockwise to the position shown in FIG. 5 in which the common switch contact 25 is rotated downward to make electrical contact with the second leg 37 of the arc fault fixed test contact 23. Again, upon completion of the test, the spring member 69 returns the common actuating member 41 and common test button 51 to the neutral position shown in FIG. 3.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a molded housing;

electronic trip means mounted in said molded housing and having a first test circuit with a first test switch including a first test contact and a second test circuit with a second test switch including a second test contact spaced from said first test contact, and a common test contact, common to both said first and second test switches, positioned between said first and second test contacts;

a dual test switch actuating assembly comprising;

a common actuating member mounted in said molded housing for rectilinear reciprocal movement between a first test position in which one of said first test contact and said common test contact is deflected into engagement wit the other to actuate said first test switch and thereby activate said first test circuit, and a second test position in which one of said second test contact and said common test contact is deflected into engagement with the other to actuate and said second test switch and thereby activate said second test circuit;

biasing means biasing said common actuating member to a neutral position between said first and second test positions in which said common test contact engages neither said first nor said second test contact;

wherein said dual test switch actuating assembly further includes a common test button coupled to said common actuating member; and means pivotally mounting said common test button for rotation in a first direction to move said common actuating member rectilinearly to said first test position, and for rotation in a second direction opposite to said first direction to move said common actuating member substantially rectilinearly against said bias means to said second test position;

wherein said bias means comprises a cantilevered spring member engaging said common actuating member and extending laterally relative to said rectilinear movement of said common actuating member;

wherein said common actuating member is a molded member and said cantilevered spring member is integrally molded with said common actuating member; and wherein said integrally molded cantilevered spring member terminates in a projection which seats in a recess in said housing in which said projection rotates as said common actuating member moves rectilinearly.

2. A circuit breaker comprising:

a molded housing;

electronic trip means mounted in said molded housing and having a first test circuit with a first test switch including a first test contact and a second test circuit with a second test switch including a second test contact spaced from said first test contact, and a common test contact, common to both said first and second test switches, positioned between said first and second test contacts;

a dual test switch actuating assembly comprising;

a common actuating member mounted in said molded housing for rectilinear reciprocal movement between a first test position in which one of said first test contact and said common test contact is deflected in to engagement with the other to actuate said first test switch and thereby activate said first test circuit, and a second test position in which one of said second test contact and said common test contact is deflected into engagement with the other to actuate said second test switch and thereby activate said second test circuit;

bias means biasing said common actuating member to a neutral position between said first and second test positions in which said common test contact engages neither said first nor said second test contact;

wherein said electronic trip means includes a printed circuit board on which said first switch contact and said second switch contact are mounted, and said common test contact comprises an electrically conductive leaf spring mounted at a first end on said printed circuit board and deflectable at a second end in a first direction of said generally rectilinear movement of said common actuator member to engage the first switch contact, and deflectable at said second end in a second direction of said generally rectilinear movement of said common actuator member to engage the second switch contact;

wherein each of said first switch contact and second switch contact is an electrically conductive leaf spring mounted on said printed circuit board and deflectable with said common electrically conductive leaf spring;

wherein said common electrically conductive leaf spring is an elongated U-shaped flat member with said first and second ends adjacent one another;

wherein said bias means comprises a cantilevered spring member engaging said common actuating member and extending laterally relative to said rectilinear movement of said common actuating member; and wherein said common actuating member is a molded member and said cantilevered spring member is integrally molded with said common actuating member.

3. A circuit breaker comprising:

a molded housing;

electronic trip means mounted in said molded housing and having a first test circuit with a first test switch including a first test contact and a second test circuit with a second test switch including a second test contact spaced from said first test contact, and a common test contact, common to both said first and second test switches, positioned between said first and second test contacts;

a dual test switch actuating assembly comprising:

a common test button mounted in said molded housing remotely from said first test switch and second test switch for movement between a first test position, a second test position and a neutral position;

a common actuating member coupled to said common test button and movable by movement of said common test button to said first test position to deflect one of said first test contact and said common test contact into contact with the other to actuate said first test switch and thereby activate said first test circuit, movable by movement of said common test button to said second test position to deflect one of said second test contact and said common test contact into engagement with the other to actuate said second test switch and thereby activate said second test circuit, and movable to a neutral position in which neither said first test switch nor said second test switch is actuated by movement of said common test button to said neutral position;

wherein said dual test switch actuating assembly includes bias means biasing said common test button and said common actuating member to said neutral position;

wherein said electronic trip means is mounted on a printed circuit board, and said first switch contact, said second switch contact and said common test contact each comprises an electrically conductive leaf spring mounted on said printed circuit board and having a deflectable leg making electrical contact with another deflectable leg; and wherein said electrically conductive leaf spring forming said common test contact is an elongated U-shaped flat member having a first leg with a first stationary end fixed to said printed circuit board and with a free end of said deflectable leg positioned adjacent said first stationary end, and said common actuating member engaging said free end of said deflectable leg of said common switch contact for actuating said first and second test switches.

4. A circuit breaker comprising:

a molded housing:

electronic trip means mounted in said molded housing and having a first test circuit with a first test switch including a first test contact and a second test circuit with a second test switch including a second test contact spaced from said first test contact, and a common test contact, common to both said first and second test switches, positioned between said first and second test contacts; and a dual test switch actuating assembly comprising:

a common test button mounted in said molded housing remotely from said first test switch and second test switch for movement between a first test position, a second test position and a neutral position;

a common actuating member coupled to said common test button and movable by movement of said common test button to said first test position to deflect one of said first test contact and said common test contact into contact with the other to actuate said first test switch and thereby activate said first test circuit, movable by movement of said common test button to said second test position to deflect one of said second test contact and said common test contact into engagement with the other to actuate said second test switch and thereby activate said second test circuit, and movable to a neutral position in which neither said first test switch nor said second test switch is actuated by movement of said common test button to said neutral position; and wherein said common actuating member is mounted for rectilinear movements by said common test button between said first and second test.

* * * * *